US006474693B1

(12) United States Patent
Nitsche

(10) Patent No.: US 6,474,693 B1
(45) Date of Patent: Nov. 5, 2002

(54) POSTER-STYLE NOVELTY ITEM

(76) Inventor: Jude Gregory Nitsche, 2403 Eccleston St., Silver Spring, MD (US) 20902

( * ) Notice: Subject to any disclaimer, the term of this patent is extended or adjusted under 35 U.S.C. 154(b) by 130 days.

(21) Appl. No.: 09/575,662

(22) Filed: Jun. 9, 2000

(51) Int. Cl.[7] ..... G09F 7/00; G09F 11/06

(52) U.S. Cl. ..... 281/21.1; 281/15.1; 40/124.01; 40/124.07; 40/124.19; 40/376; 40/492; 40/610; 40/538; 40/617

(58) Field of Search ..... 281/15.1, 21.1; 40/376, 492, 124.01, 124.19, 124.07, 617, 610, 538

(56) References Cited

U.S. PATENT DOCUMENTS

| | | | | | |
|---|---|---|---|---|---|
| 100,994 | A | * | 3/1870 | Fitch et al. | 281/15.1 |
| 1,142,007 | A | * | 6/1915 | Bauer | 281/15.1 |
| 2,156,551 | A | * | 5/1939 | Stark | 129/16.5 |
| 2,334,298 | A | * | 11/1943 | Vallone | 230/269 |
| 3,950,871 | A | * | 4/1976 | Rege | 402/48 |
| 4,070,775 | A | * | 1/1978 | Brooks | 40/492 |
| 4,104,809 | A | * | 8/1978 | Day et al. | 40/492 |
| 4,253,259 | A | * | 3/1981 | Schaffer et al. | 40/492 |
| 5,106,090 | A | * | 4/1992 | Greenwood | 281/15.1 |
| 5,358,280 | A | * | 10/1994 | Scales | 283/63.1 |
| D357,280 | S | * | 4/1995 | Bechler et al. | D19/64 |
| 5,928,797 | A | * | 7/1999 | Vineberg | 428/500 |

OTHER PUBLICATIONS

Brain Quest, First Grade Math, Workman Publishing Company, 2000.

* cited by examiner

*Primary Examiner*—A. L. Wellington
*Assistant Examiner*—Mark T. Henderson
(74) *Attorney, Agent, or Firm*—Oblon, Spivak, McClelland, Maier & Neustadt, P.C.

(57) ABSTRACT

A novelty item in which pages can be rotated about a fastener to form an integrated image on one side of the pages while forming independent pages of text and/or graphics on the other side. Such an item can be used as a combination comic book and poster. By including at least one die-cut hole, the combination comic book and poster can be hung on the wall using the nail or hook.

24 Claims, 5 Drawing Sheets

FRONT VIEW

BACK VIEW

POSTER-STYLE NOVELTY ITEM

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Description of Related Art

Various children's books have been created that include plural pages (often constructed of a cardboard-like material) and an attachment in one corner to bind the pages together. In one such known book, on a first face of the pages is one or a combination of (1) a textual story for the child to read or (2) individual pictures on the pages. Those books, however, have not provided a single cohesive image across substantially the entirety of one of the faces, and, therefore, were inappropriate to act as a poster.

Ornamental fans also exist that have designs on at least one side. Those fans have been made from a single sheet of paper or cloth such that the entire image is formed on the single sheet or cloth. Moreover, those fans have been fastened at one of their ends such that the fan can be opened. Such fans, however, do not act as a book or story and are made from a folded sheet or cloth that detracts from the overall design.

2. Field of the Invention

The present invention is directed to a printed novelty item and more particularly to a novelty item that acts as a book on a first face and a poster on a second face.

BRIEF SUMMARY OF THE INVENTION

It is an object of the present invention to provide a novelty item that acts as (1) at least one of a book and an advertisement on a first side and (2) a poster on a second side.

This object, and other advantages of the present invention, is achieved by a combination of elements including (1) a series of pages having concentric holes included therein, (2) a connector inserted within the concentric holes for coupling the pages together while still allowing the pages to rotate about a center of the concentric holes while the pages are bound by connector, and (3) a series of attachment points for connecting the pages to one another when the pages have been rotated about the concentric holes. Embodiments of the present invention include, but are not limited to, grommets and rivets acting as the connector.

BRIEF DESCRIPTION OF THE SEVERAL VIEWS OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1A:
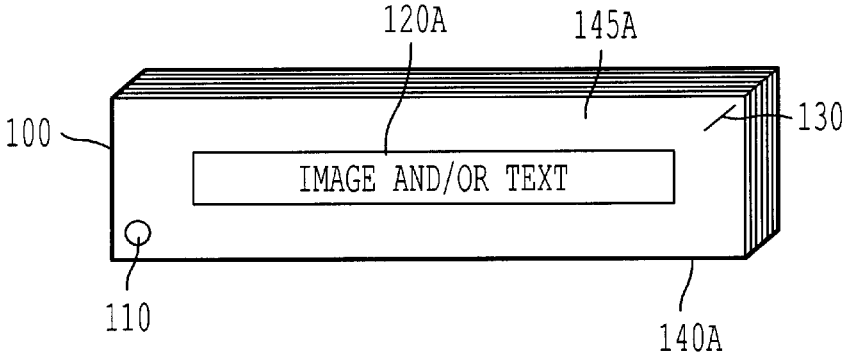
FIGS. 1A and 1B are front views of the novelty item according to the present invention in which the pages are in a substantially completely closed position.
Figure 2A:
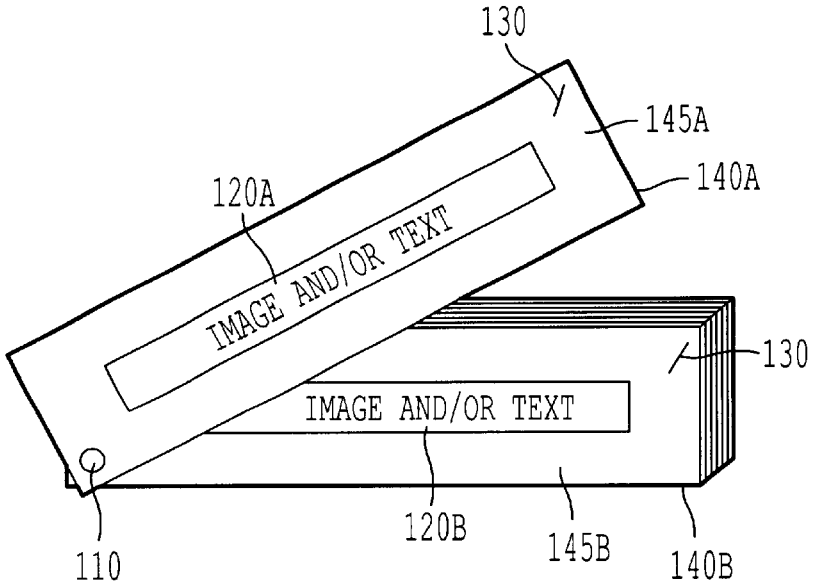
FIGS. 2A and 2B are front views of the novelty item according to the present invention in which the first page is in a partially open position but the remaining pages are in a substantially completely closed position.

Referring now to the drawings, wherein like reference numerals designate identical or corresponding parts throughout the several views, FIG. 1 is a front view of the novelty item 100 according to the present invention in which the pages 140 are in a substantially completely closed position. The pages 140 includes holes in substantially a corner position thereof such that the holes are substantially concentric between pages 140. The holes can be, but are not limited to, die-cut holes and drilled holes. When grouped together, the concentric holes enable the connector 110 to be placed such that the pages 140 are held together but can rotate about the connector 110.

Figure 1B:
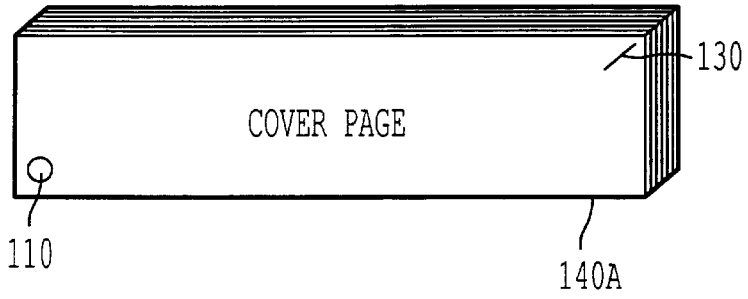

In one embodiment, the first side of the first page 145A includes one, or a combination of, an image and text 120A. As shown in FIG. 1B, one possible implementation of the first page is as a cover page of a book. As would be appreciated, cover pages often include a combination of artwork and text showing the title of the book.

Figure 2B:
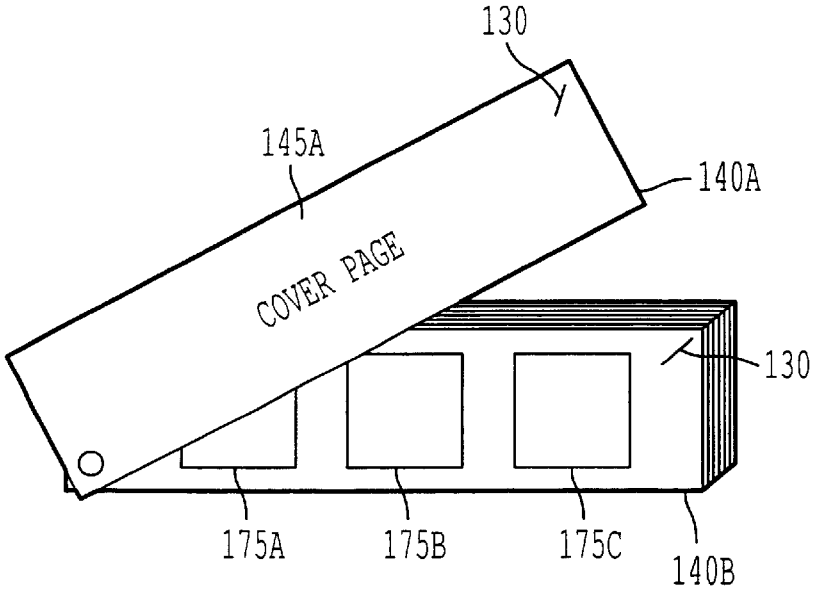

In one embodiment, the first side of the second page 145B includes one, or a combination of, an image and text 120B which can be the same or, but is likely different than, the text and/or image 120A of the first side of the first page 145A. As shown in FIG. 2B, one possible implementation of the first page is as a first page of a story. The story includes several sequential panels 175A–175C such as are found in comic books. As would be appreciated by one of ordinary skill in the art, the story may simply be a series of text that runs across a width of the page.

Figure 3:
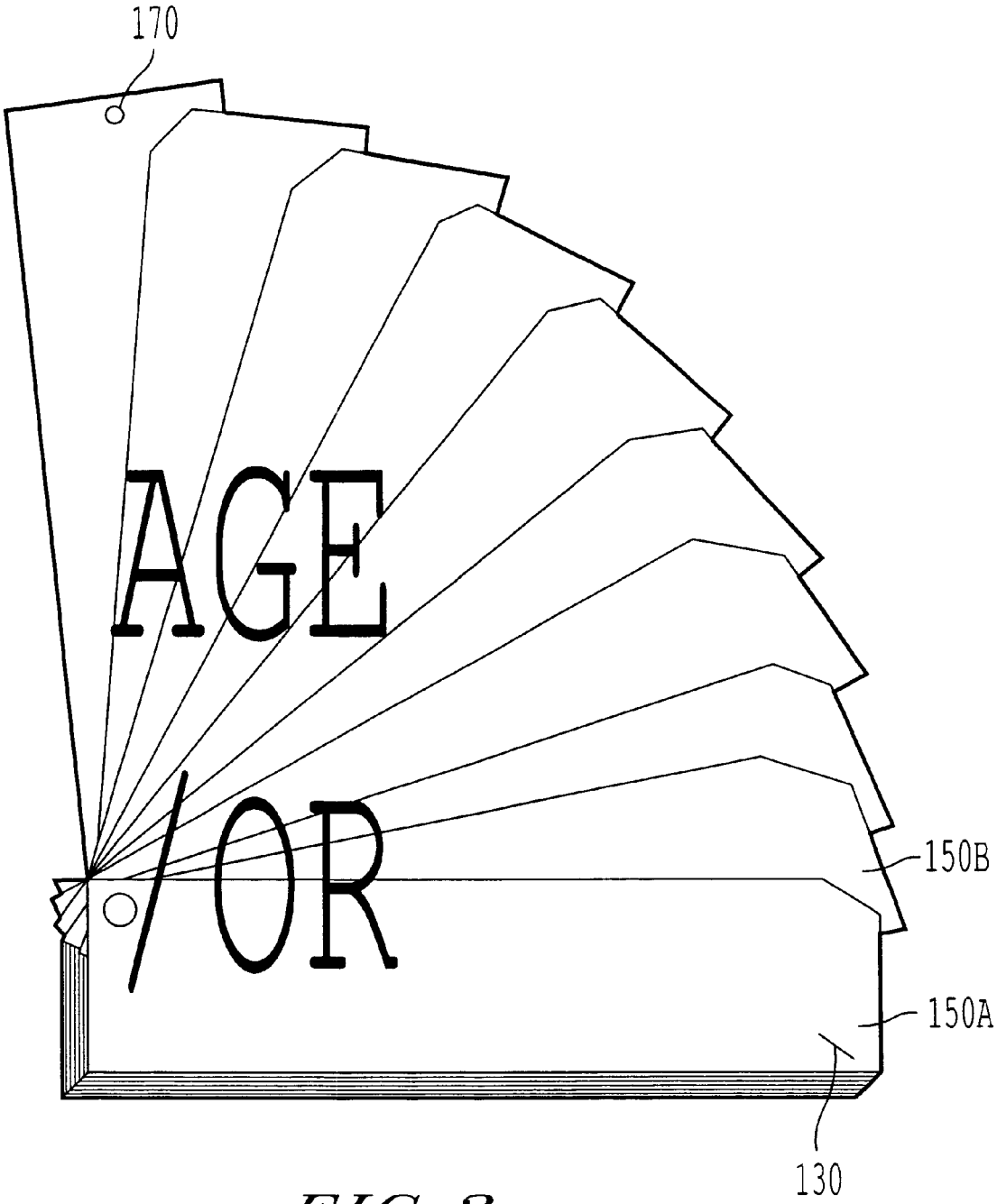
FIG. 3 is a back view of the novelty item according to the present invention in which a number of pages of the item have been opened and interlocked thereby revealing substantially a quarter of an integrated image thereon.
Figure 4:
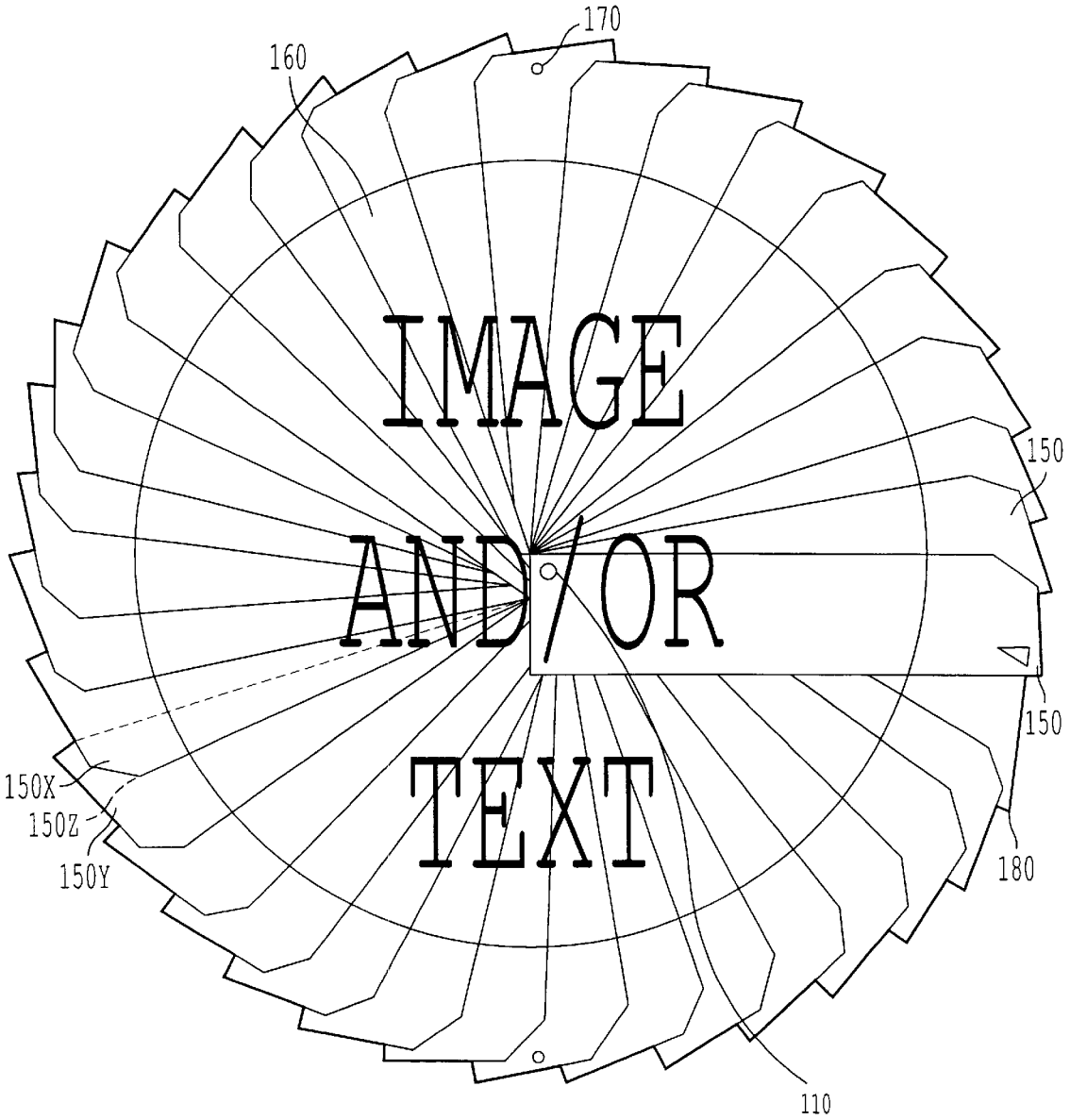
FIG. 4 is a back view of the novelty item according to the present invention in which substantially all of the pages of the item have been opened and interlocked thereby revealing substantially all of the integrated image thereon.
Figure 5:
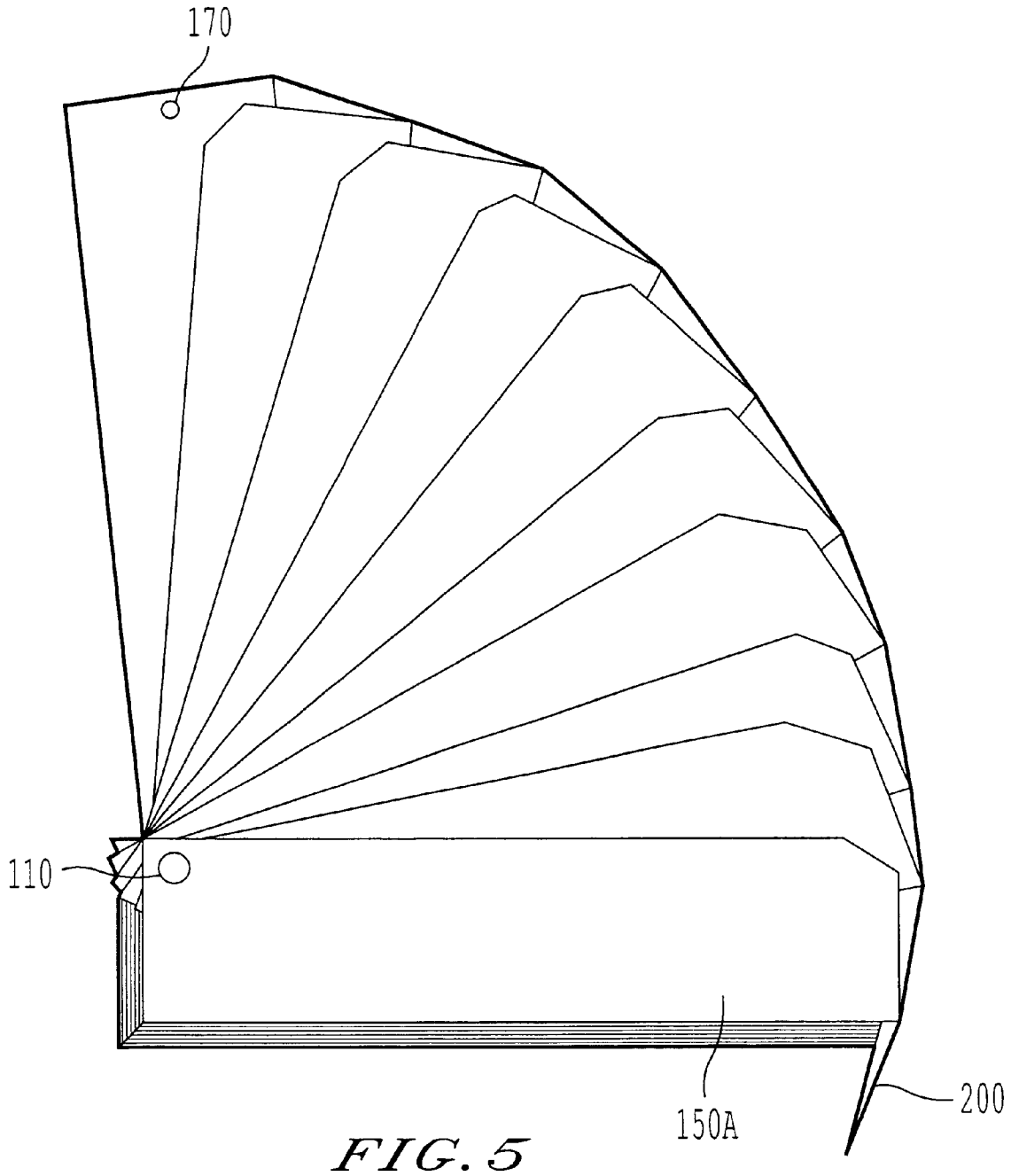
FIG. 5 is a back view of the novelty item according to the present invention in which the pages are substantially similar to the pages of FIG. 4 but include at least one additional tab that acts to round the integrated image in the open position.

As shown in FIG. 3, in the open (i.e., rotated) position, the backs of several pages 150A and 150B join together to form a portion of an image that is shown in its entirety in FIG. 4. In the open position, each of the pages is interlocked using an attachment point (e.g., a slot 130). In a preferred environment, the slot 130 is a die-cut slot, and the hole is a die-cut hole. Alternately, the hole can be a drilled hole. As is shown in figure four, the resulting image 160 may not extend an entire length of the page. Instead, depending on image to be displayed, a reduced area of the page 150 may be used.

In order to prevent visual gaps in the image 160, in a preferred embodiment, the portion of the image 160 that is hidden by page 150X is continued, at least partially, on page 150Y, although normally out of view. If instead that portion did not generally continue the image 150Y (e.g., but was made a solid background color (such as white) starting immediately at 150Z), small variations in how the pages 140 interlock would expose the background color, thereby providing a less aesthetic image.

Once the image of figure four has been made in its entirety, the novelty item 100 can be hung using a hole 170 that is formed near the exterior of one of the pages.

As can be seen in the open view of figure four, the corners at 180 of the pages 140 create a jagged image when the corners 180 are substantially straight. As shown in figure five, the addition of a tab 200 creates a smoothing effect as the pages 140 are opened. In an alternate embodiment that produces a smoothing effect, the corner of the series of pages opposite the fastener 110 utilizes a rounded corner.

In order to facilitate the rotation the pages 140, the fastener 110 is fabricated as a smooth sided cylinder. Exemplary embodiments of the cylinder include a grommet and a rivet; however others semi-rigid fasteners can be used as well. Grommets can include, but are not limited to, snap grommets and screw grommets.

In yet another alternative embodiment, the slot 130 (acting as an attachment point) is replaced by a light adhesive (i.e., an adhesive strong enough to enable the pages to stick together when hanging in poster form and weak enough to enable the pages to be unstuck without damaging the images on the pages). In the light adhesive-based embodiment, the corners of the pages 140 stick on top of one another rather than becoming physically interlocking. Other alternate embodiments of the attachment points are also possible. Such embodiments include, but are not limited to, Velcro and tape.

In alternate embodiments of the present invention, the image and/or text 120 on the pages 140 is replaced by a blank surface upon which any number of other stickers or temporary tattoos can be affixed. Such stickers can include, but are not limited to, single image stickers, holograms and scratch-and-sniff stickers. As would be understood, such stickers and tattoos can be affixed during either (1) the same printing step as the unified image on the opposite side or (2) an independent printing step.

In yet another alternate embodiment of the present invention, the image and/or text 120 on the pages 140 is replaced with any one or a combination of (1) black and white line-art that is meant to be colored or painted (eg. a paint-by-numbers design), (2) art that animates in conjunction with a lenticular lens, and (3) trading card images.

Obviously, numerous modifications and variations of the present invention are possible in light of the above teachings. It is therefore to be understood that, within the scope of the appended claims, the invention may be practiced otherwise than as specifically described herein.

DEPOSIT OF COMPUTER PROGRAM LISTINGS

Not applicable

What is claimed is:

1. A novelty item comprising:

a series of pages having concentric holes included therein;

a connector inserted within the concentric holes for coupling the series of pages together while still allowing the series of pages to rotate about the concentric holes while the pages are coupled by the connector; and a series of attachment points for connecting adjacent pages to one another when the series of pages has been rotated about the concentric holes, wherein the series of attachment points are slits near the corner opposite a corner of the concentric hole of the series of pages, and wherein the slit of am first page receives a corner of an adjacent second page such that the corner of the second page is interlocked with the slit on the first page between two ends of the split.

2. The novelty item as claimed in claim 1, wherein at least a first side of the series of pages forms an integrated image when the series of pages has been rotated about the concentric holes.

3. The novelty item as claimed in claim 1, wherein at least a first side of the series of pages forms an integrated image when the series of pages has been rotated about the concentric holes and attached at the series of attachment points.

4. The novelty item as claimed in claim 1, wherein the slits comprise die-cut slits.

5. The novelty item as claimed in claim 1, wherein the concentric holes comprise at least one of die-cut holes and drilled holes.

6. The novelty item as claimed in claim 1, wherein the fastener comprises a grommet.

7. The novelty item as claimed in claim 1, wherein the fastener comprises a rivet.

8. The novelty item as claimed in claim 1, wherein the slits do not touch any side edge of the series of pages.

9. The novelty item as claimed in claim 1, wherein the slits are substantially diagonal compared to the edges forming the corner closet to the slits.

10. The novelty item as claimed in claim 1, wherein a corner of a first page of the series of pages interlocks with a slit of a last page of the series of the pages.

11. The novelty item as claimed in claim 1, wherein the series of pages forms a 360 degree image.

12. The novelty items as claimed in claim 1, further comprising a hole in an edge of at least one page of the series of pages to suspend the novelty item when the series of pages has been rotated about the concentric holes and attached at the series of attachment points.

13. The novelty item as claimed in claim 2, wherein second sides of the series of pages form a series of images.

14. The novelty item as claimed in claim 2, wherein second sides of the series of pages form a progression of images.

15. The novelty item as claimed in claim 2, wherein second sides of the series of pages form a series of cartoon panes.

16. The novelty item as claimed in claim 2, wherein second sides of the series of pages form a series of comic strip panes.

17. The novelty item as claimed in claim 2, wherein the integrated image comprises an image of a cartoon character.

18. The novelty item as claimed in claim 2, wherein the integrated image comprises an image of a comic book character.

19. The novelty item as claimed in claim 2, wherein the integrated image comprises an advertising image.

20. The novelty item as claimed in claim 2, wherein the series of pages are not made from folded pages.

21. The novelty item as claimed in claim 2, wherein substantially each page of the series of pages forms a portion of the integrated image when the series of pages has been rotated about the concentric holes.

22. The novelty item as claimed in claim 2, wherein second sides of the series of pages comprise stickers.

23. The novelty item as claimed in claim 2, wherein second sides of the series of pages comprise temporary tattoos.

24. The novelty item as claimed in claim 2, wherein second sides of the series of pages form a progression of text.

* * * * *